United States Patent [19]

Fujitani et al.

[11] Patent Number: 4,940,430

[45] Date of Patent: Jul. 10, 1990

[54] ELECTRICAL CONNECTOR WITH OPENABLE COVER

[75] Inventors: Mitsuhiro Fujitani; Hiroyuki Oka, both of Mie; Seiji Hirano, Hiroshima, all of Japan

[73] Assignee: Sumitomo Wiring Systems, Ltd., Yokkaichi, Japan

[21] Appl. No.: 304,287

[22] Filed: Jan. 31, 1989

[30] Foreign Application Priority Data

Feb. 1, 1988 [JP] Japan ..... 63-12650[U]
Feb. 1, 1988 [JP] Japan ..... 63-12651

[51] Int. Cl.[5] ..... H01R 13/502

[52] U.S. Cl. ..... 439/686; 439/352; 439/488

[58] Field of Search ..... 439/352, 357, 488, 599, 439/634, 686, 689, 687, 690, 691, 693, 695, 701, 718, 104; 174/138 F

[56] References Cited

U.S. PATENT DOCUMENTS 4,711,508 12/1987 Sueyoshi ..... 439/595

FOREIGN PATENT DOCUMENTS

• 57-10470 3/1982 Japan .

*Primary Examiner*—Neil Abrams
*Assistant Examiner*—Khiem Nguyen
*Attorney, Agent, or Firm*—Cushman, Darby & Cushman

[57] ABSTRACT

An electrical connector with an openable cover. The front half of an upper wall of the connector housing is removed to provide an opening with a slide cover provided for covering the opening. A peep notch is formed in the front edge of the upper wall of the connector. The slide cover is configured such that in a closed position a peep gap appears between the rear edge of the slide cover and the front top edge of the connector housing. A retainer mechanism is provided on the cover which comprises an angular projection formed on the slide cover and having a guide surface, and a retainer projection formed on the lower surface of the front edge of the housing whereby the retainer projection is guided by the guide surface to be engaged with the angular projection locking the slide cover in its closed position. A resilient, cantilever type, retainer piece is provided for insuring a positive, locked seating with a mating connector. The slide cover has a depressible plate of a cantilever type disposed parallel to the resilient retainer piece and has an urging projection formed on its lower surface at its free end. When the slide cover is in its retracted position the urging projection is positioned at an intermediate point of the retainer piece so that the retaining piece is moved downward and the connector is released from the mating connector in response to depression of the depressible plate.

2 Claims, 4 Drawing Sheets

ELECTRICAL CONNECTOR WITH OPENABLE COVER

BACKGROUND OF THE INVENTION

This invention relates to an electrical connector provided with an openable cover and connectable to a printed circuit board, etc., of a mating connector in an electrical wiring of an automobile.

A conventional electrical connector having an openable cover is disclosed in, for example, Japanese Utility Model Publication No. 10470/82. FIG. 1 shows such a conventional connector which is provided with a plate-like slide cover 2 separate from a housing 1. The slide cover is inserted into insertion grooves 6, provided respectively at opposite sides of the housing 1, from the rear side of the housing so that the slide cover 2 is slidable in forward and backward directions. In order to protect terminals having respective exposed tongues 5 and mounted within an upwardly-opening terminal-receiving chamber 3 provided at a front half of the housing 1, the slide cover 2 is moved forwardly to its closed position indicated by broken lines 2" to cover the tongues 5 from above. For connecting the housing 1 to the mating connector, the slide cover 2 is pushed to its retracted position as indicated by a solid line 2' to open a region above the tongues 5. When the slide cover 2 is in its closed position 2", a projection 18 formed on the rear end of the slide cover 2 is pressed against an underside of an upper wall 7 of the housing 1 to retain the slide cover 2 by the resistance offered by this contact pressure.

In the conventional electrical connector having the above-mentioned openable cover, the retaining force to hold the slide cover 2 in its closed position is not sufficiently high so that the slide cover 2 can easily be retracted when subjected to an external force during transportation or operation, to expose the tongues 5. Thus, the slide cover fails to perform the function of protecting the terminals, so that the tongues 5 may be damaged or deformed.

Further, the slide cover 2 is manually set in its closed position at the attaching of the terminals to the connector in a wire harness assemblage line or the like. Therefore, in the above conventional construction, whether or not the slide cover 2 is properly set in its closed position, has to be judged by the fingertip feeling to the resistance offered by the contact pressure of the projection 18. That is, the proper setting can not be inspected visually, which sometimes results in a problem that the slide cover 2 fails to be properly set.

FIG. 2 shows another conventional connector having an openable cover. In FIG. 2, the same reference numeral as that in FIG. 1 designates the same or the like member. In this connector, a resilient retainer piece 27 of a cantilever type extends forwardly with its fixed end at a rear portion of a housing 1, the retainer piece 27 being disposed centrally of an opening 4 provided at the front half of the housing 1. The resilient retainer piece 27 has a retaining means for locking the housing relative to a mating housing, the retaining means comprising a locking pawl 28 formed at the free end of the retainer piece 27 and engageable in an engaging hole formed in the mating housing, and a depressible projection 29 of an inverted U-shape formed on a rear portion of the upper surface of the resilient retainer piece 27. For connecting the two housings together, a slide cover 2 is held in its retracted position 2', with the resilient retainer piece 27 held in its free condition, and in this condition the housing 1 is pushed into the mating housing. As a result, the locking pawl 28 is snappingly fitted in the engaging hole of the mating housing to lockingly retain this connecting posture. For releasing this connecting posture, the depressible projection 29 of the resilient retainer piece 27 is depressed by the finger or the like, so that the resilient retainer piece 27 is flexed downwardly to release the locking engagement of the locking pawl 28.

In the above conventional electrical connector with the openable cover, when the housing 1 is to be connected to the mating housing, the depressible projection 29 is sometimes unintentionally depressed by the finger to downwardly flex the resilient retainer piece 27 unnecessarily, and the housing 1 is connected to the mating housing in this condition. If the connection is made in such a manner, the feeling of the above-mentioned snapping engagement due to the resiliency of the resilient retainer piece 27 is not obtained, which results in a problem that the resilient retainer piece 27 is not properly engaged due to an inadequate amount of insertion thereof. An operator tends to inadvertently depress the depressible projection 29 at a certain rate, and this can not be avoided because of the manual operation to connect the housings together and of the presence of the inverted U-shaped projection.

SUMMARY OF THE INVENTION

An object of this invention is to provide a novel electrical connector which overcomes the above problems.

According to a first embodiment of the present invention, an electrical connector with an openable cover wherein a front half of an upper wall of a connector housing is removed to provide an opening; tongues of terminals in a terminal receiving chamber are exposed at the opening; and a slide cover is provided for opening and closing the opening; characterized in that a peep notch is formed in a front edge of the upper wall of the connector housing; the slide cover is of such a configuration that in a closed position of the slide cover, a peep gap appears between a rear edge of the slide cover and an edge of the peep notch; and there is provided a retainer mechanism which comprises an angular projection formed on the slide cover and having a guide surface, and a retainer projection formed on a lower side of the front edge of the upper wall of the connector housing whereby the retainer projection is guided by the guide surface to be engaged with the angular projection to thereby lock the slide cover in its closed position.

In the electrical connector of the above construction according to the first embodiment of the present invention, when the opening is to be closed by the slide cover, the retainer mechanism constituted by the angular projection on the slide cover and the retainer projection on the connector housing is snappingly engaged after the guiding operation by the guide surface, thereby preventing the slide cover from being retracted. Therefore, an increased retaining force for retaining the slide cover is obtained, and a feeling obtained during the operation of locking the slide cover in its closed position becomes much better.

Further, when the slide cover is locked in its closed position, this lockingly closed position can be inspected at a glance since the peep gap appears adjacent to the rear edge of the slide cover.

According to a second embodiment of the present invention, an electrical connector with an openable cover wherein a front half of an upper wall of a connector housing is removed to provide an opening; tongues of terminals in a terminal receiving chamber are exposed at the opening; a slide cover is provided for opening and closing the opening; and a resilient retainer piece of a cantilever type is provided for lockingly retaining a posture of connection to a mating connector; characterized in that the slide cover has a depressible plate of a cantilever type disposed parallel to the resilient retainer piece and having an urging projection formed on its lower surface at its free end, and when the slide cover opens the opening, the urging projection is positioned at an intermediate depression point of the resilient retainer piece so that the depressible plate and the resilient retainer piece overlap each other whereby the locking retaining is released by moving the resilient retainer piece in response to the depression of the depressible plate.

In the electrical connector of the above construction according to the second embodiment of the present invention, the resilient retainer piece of the housing overlaps the depressible plate of the slide cover, and the resilient retainer piece is moved in response to the depression of the depressible plate. Therefore, the locking retaining of the connector housing in its connected condition can be released by depressing the depressible plate. Any unnecessary projection is not provided on the upper surface of the resilient retainer piece, and this prevents an inadvertent depression of the resilient retainer piece at the time when the connector housing is to be connected, and a good feeling of the locking engagement of the resilient retainer piece can be maintained.

BRIEF DESCRIPTION OF THE DRAWINGS

FIGS. 3(A)-3(B) show an electrical connector with an openable cover according to the first embodiment of the present invention, in which FIG. 3(A) is an overall perspective view thereof; FIG. 3(B) is a perspective view showing a closed condition thereof; and FIG. 3(C) is a cross-sectional view showing the operation thereof; and FIGS. 4(A) and 4(B) show an electrical connector with an openable cover according the second embodiment of the present invention, in which FIG. 4(A) is a perspective view thereof; and FIG. 4(B) is a cross-sectional view of the main portion thereof.

DETAILED DESCRIPTION OF THE PREFERRED EMBODIMENTS

Preferred embodiments of the invention will now be described in detail with reference to the attached drawings.

Figure 1:
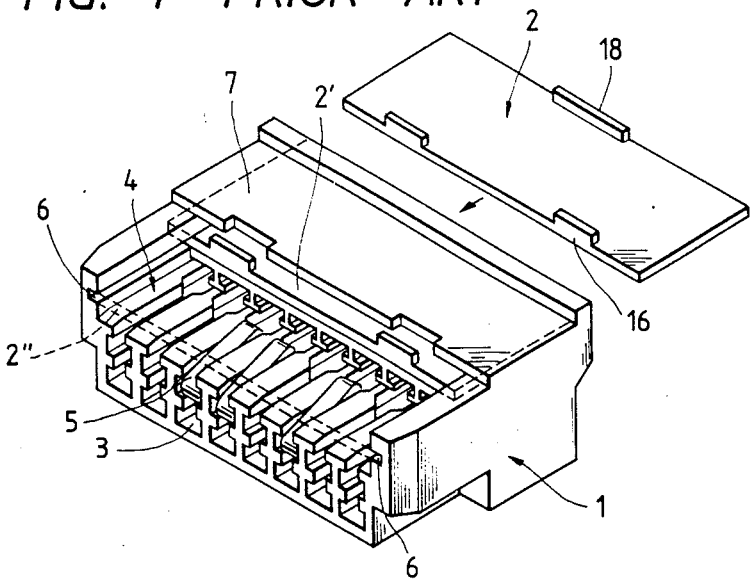
FIG. 1 PRIOR ART
FIG. 1 is a perspective view of a conventional electrical connector with an openable cover.
Figure 3:
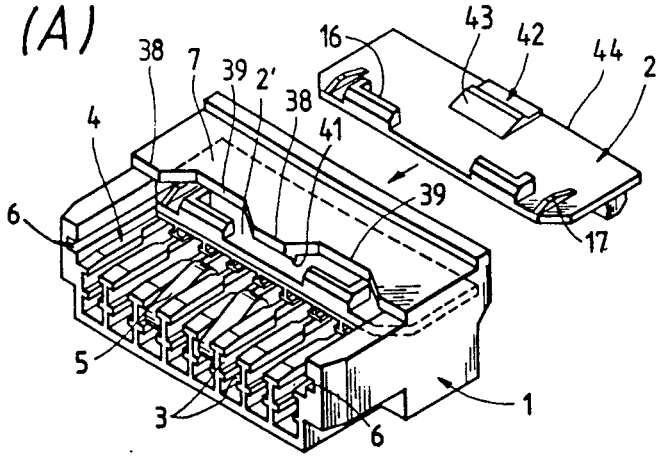
Figure 3:
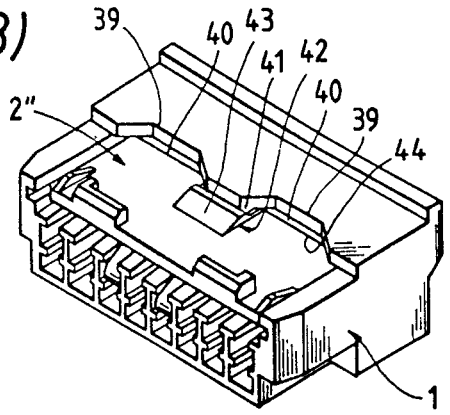
Figure 3:
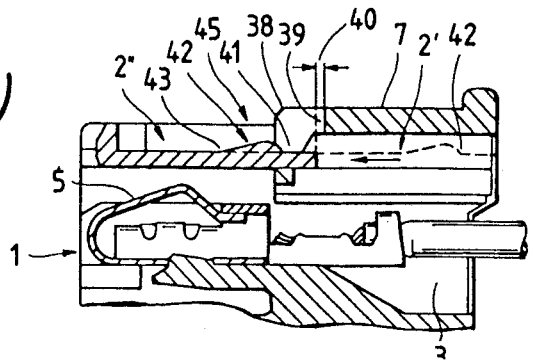

FIGS. 3(A)-3(C) shows an electrical connector with an openable cover provided in accordance with the first embodiment of the present invention, in which the same reference numeral as that in FIG. 1 designates the same or the like member. The electrical connector comprises a housing 1 and a plate-like slide cover 2 separate from the housing. More specifically, an upper wall 7 of the housing 1 is omitted at a region corresponding to a front half of the housing, so that a top of a terminal-receiving chamber 3 is open to provide an opening 4 to thereby expose tongues 5 of terminals mounted in the terminal-receiving chamber 3. The plate-like slide cover 2 is inserted into insertion grooves 6, formed respectively in inner surfaces of opposite side walls of the housing 1, from the rear side of the housing 1 so that the opening 4 can be opened and closed by the slide cover 2. In this electrical connector with the openable cover, a pair of peep notches 39 of a generally U-shape are formed in a front edge 38 of the upper wall 7. When the slide cover 2 advances to its closed position 2" to close the opening 4 as shown in FIGS. 3(B) and 3(C), peep gaps 40 appear between the rear edge 44 of the slide cover 2 and the edges of the peep notches 39.

A downwardly-projecting retainer projection 41 is formed on a lower surface of the front edge 38 positioned between the pair of peep notches 39. A projection 42 of an angular shape is formed on the slide cover 2 adjacent to the rear edge 44 of the slide cover 2, the projection 42 having a guide surface 43 slanting gently and forwardly. When the slide cover 2 is set in its closed position 2" as shown in FIGS. 3(B) and 3(C), the retainer projection 41 and the angular projection 42 are engaged with each other to prevent the slide cover 2 from being retracted. That is, these two projections constitute a retainer mechanism. More specifically, when the slide cover 2 inserted into the housing 1 is advanced from its open position 2' where the opening 4 is opened, the retainer projection 41 formed on the lower surface of the front edge 38 of the upper wall 7 of the housing 1 interferes with the guide surface 43 of the angular projection 42 formed on the rear portion of the slide cover 2, so that a portion of the upper wall 7 positioned at the vicinity of the retainer projection 41 is elastically deformed outwardly. When the apex of the guide surface 43 passes past the retainer projection 41 to terminate its pressure contact with the retainer projection, the retainer projection 41 and the angular projection 42 are snappingly engaged with each other due to a reaction force applied by the elastic deformation of the upper wall 7, thereby preventing the slide cover 2 from being retracted.

In the drawings, reference numeral 16 denotes manipulation lugs used for sliding the slide cover 2, and reference numeral 17 denotes guide pieces for guiding the sliding movement of the slide cover 2 along the insertion grooves 6.

In the above-mentioned electrical connector with the openable cover according to the first embodiment of the present invention, when the opening 4 is to be closed by the slide cover 2, the retainer projection 41 and the guide surface 43 of the angular projection 42 interfere with each other immediately before the slide cover reaches its closed position 2", thereby offering a slight resistance. Thereafter, these two projections are snappingly engaged with each other. Therefore, the feeling obtained when the slide cover 2 is manually set in its closed position is very good, thereby facilitating the setting of the slide cover in its closed position. When the slide cover 2 is properly set in its closed posture, the peep gaps 40 appear, and therefore the set posture can be accurately inspected at a glance, thereby preventing a defective setting having an improper closure.

Further, since the electrical connector according to the first embodiment is provided with the retainer mechanism 45 constituted by the retainer projection 41 and the angular projection 42, there can be provided a high retaining force acting against an external force tending to retract the slide cover 2, thereby improving the closure setting ability of the slide cover 2. Therefore, an accidental retraction of the slide cover 2 is prevented, and the tongues 5 of the terminals are fully protected.

As described above, the electrical connector with the openable cover according to the first embodiment stabilizes the closure setting posture of the slide cover to improve the ability of protecting the terminals, and also improves the operability in the closure setting of the slide cover, thereby preventing detective products having an improper closure setting of the slide cover.

Figure 2:
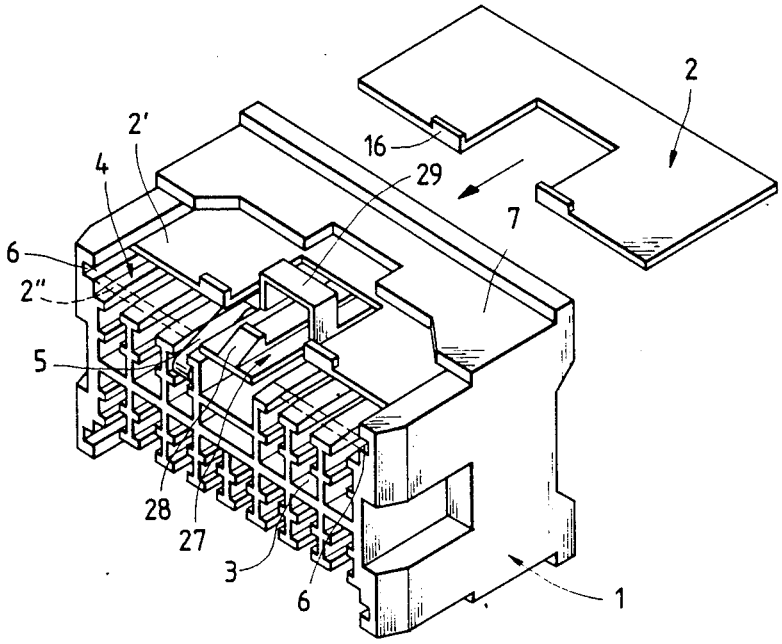
FIG. 2 PRIOR ART
FIG. 2 is a perspective view of another conventional electrical connector with an openable cover.
Figure 4A:
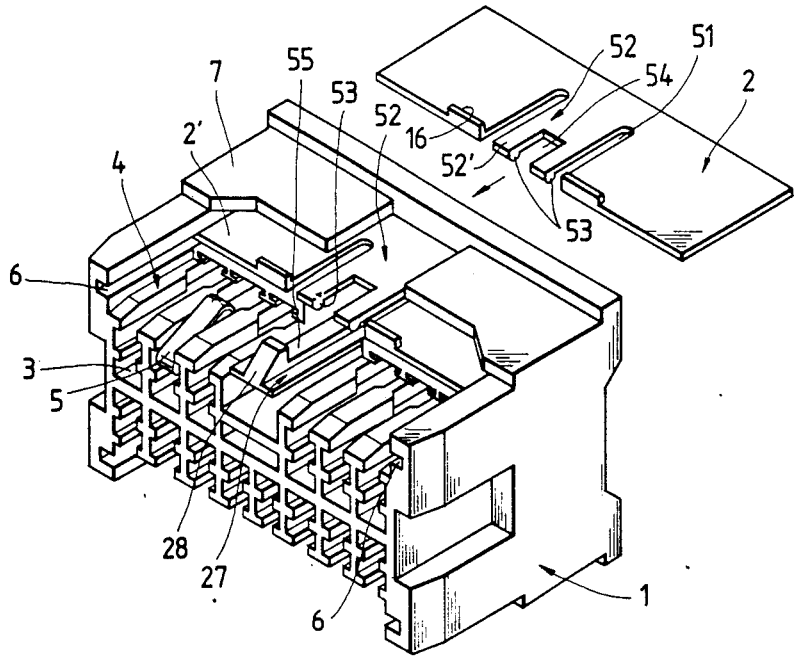
Figure 4B:
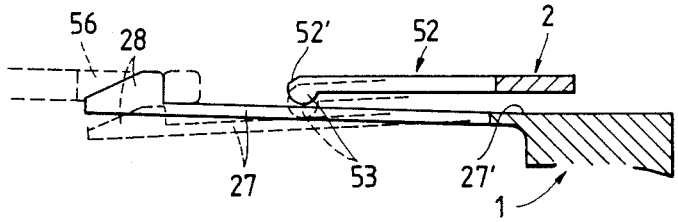

FIGS. 4(A) and 4(B) show an electrical connector with an openable cover according to the second embodiment of the present invention, in which the same reference numeral as that in FIG. 2 designates the same or the like member. The electrical connector comprises a housing 1 and a slide cover 2 separate from the housing 1. More specifically, a wall 7 of the housing 1 is omitted at a region corresponding to a front half of the housing, so that the top of a terminal receiving chamber 3 is open to provide an opening 4 to thereby expose tongues 5 of terminals mounted in the terminal receiving chamber 3. The slide cover 2 is inserted into insertion grooves 6, formed respectively in inner surface of opposite side walls of the housing 1, from the rear side of the housing 1 so that the slide cover 2 can open and close the opening 4. In this electrical connector with the openable cover, a resilient retainer piece 27 of a cantilever type extends forwardly with its fixed end 27' at a rear portion of the housing 1 in parallel relation to the terminal-receiving chamber 3, the resilient retainer piece 27 being disposed centrally of the terminal-receiving chamber 3. A locking pawl 28 is formed at the free end of the resilient retainer piece 27, which is engageable in an engaging hole formed in a mating housing to lockingly retain a posture of connection between the two housings. Except for a portion of the resilient retainer piece 27 on which the locking pawl 28 is formed, the upper surface of the resilient retainer piece 27 is generally flat, and any projection, such as the depressible projection 28 shown in FIG. 2, is not provided on this upper surface.

The slide cover 2 has a depressible plate 52 of a cantilever type delimited by slits 51 and extending forwardly from a rear portion of the slide cover 2, the depressible plate 52 having an urging projection 53 formed on its lower surface at its free end and directed downwardly. When the slide cover 2 inserted into the housing 1, is in its retracted position 2' to open the opening 4, the depressible plate 52 is positioned in overlapping relation to the resilient retainer piece 27 of the housing 1, with the free end 52' of the depressible plate 52 positioned at an intermediate depression point of of the resilient retainer piece 27. In this condition, when the depressible plate 52 is depressed by the finger or the like, the urging projection 53 presses the depression point of the resilient retainer piece 27 as shown in FIG. 4(B), so that the resilient retainer piece 27 is flexed downwardly in response to the depression of the depressible plate 52 to downwardly move the locking pawl 28 formed at the free end of the resilient retainer piece.

In FIG. 4(A), reference numeral 54 denotes a central notch formed in the depressible plate 52. When the depressible plate 52 is depressed, the notch 54 receives a reinforcement rib 55 formed on the upper surface of the resilient retainer piece 27 so as to avoid an interference of the reinforcement rib 55. Reference numeral 16 denotes manipulating pieces for sliding the slide cover 2.

In the electrical connector of the above construction, when the housing 1 is to be disconnected from the mating housing, the depressible plate 52 of the slide cover 2 positioned in its retracted position 2' is depressed by the finger or the like, so that the resilient depressible plate 52 of the cantilever type and the resilient retainer piece 27 are downwardly flexed together. As a result, the locking engagement of the locking pawl 28 with an engaging hole 56 of the mating housing is released. In this condition, the housing 1 can be easily disconnected from the mating housing by moving these two housing apart from each other.

When the two housings are to be connected together, the depressible plate 52 and the resilient retainer piece 27 in their free conditions are merely inserted. Except for the locking pawl 28, no projection is provided on the upper surface of either of the resilient retainer piece 27 and the depressible plate 52. Therefore, the risk of inadvertent depression as encountered with the conventional structure can be greatly reduced, and a good feeling of the locking engagement of the resilient retainer piece 27 can be maintained, thereby preventing an improper locking engagement.

As described above, in the electrical connector with the openable cover according to the second embodiment of the present invention, when the connector housing is to be connected to the mating housing, the inadvertent depression of the resilient retainer piece 27 is prevented to thereby eliminate an improper locking engagement of the resilient retainer piece 27, which improves the reliability to the quality of the connector.

What is claimed is:

1. An electrical connector, comprising:

a connector housing having an upper wall with a front portion of said upper wall removed to provide an opening and a peep notch formed into the front edge of said upper wall;

tongues of terminals disposed in said housing and exposed at said opening;

a cover slidably mounted so as to be able to slide open to reveal said upper wall opening and to slide closed to hide said upper wall opening and reveal a peep gap between a rear edge of said cover and said front edge of said upper wall as a result of said peep notch; and a cover retainer mechanism comprising, an angular projection formed on the top of said cover with a sloped guide surface, and a retainer projection formed on the lower side of the front edge of said upper wall whereby said retainer projection is guided by said guide surface to be engaged with said angular projection when said cover is in a fully closed position to lock said cover in a fully closed position.

2. An electrical connector, comprising:

a connector housing having an upper wall with a front portion of said upper wall removed to provide an opening;

tongues of terminals disposed in said housing and exposed at said opening;

an cover slidably mounted so as to be able to slide open to reveal said upper wall opening and to slide closed to hide said upper wall opening with a depressible plate of the cantilever type formed in said cover with the fixed end of said depressible plate disposed at the back of said cover and the free end of said depressible plate extending to the front of said cover;

a resilient retainer piece of a cantilever type fixed to the back of said housing, directly below and parallel with said depressible plate, with an angular projection at its free end positioned so as to engage with a notch formed on a mating connector when said connector and said mating connector are fully seated; and an urging projection formed on the lower surface of the free end of said depressible plate positioned so as to lie directly above an intermediate point of said resilient retainer piece when said cover is in a fully open position so that resilient retainer piece is moved downward and said housing is released from a mating connector in response to a depression of said depressible plate only when said slidable cover is in a fully open position.

* * * * *